US006644844B2

(12) United States Patent
Neal et al.

(10) Patent No.: US 6,644,844 B2
(45) Date of Patent: Nov. 11, 2003

(54) MOBILE BLENDING APPARATUS

(75) Inventors: Dan Neal, Duncan, OK (US); John Callihan, Hastings, OK (US); Kavin Bowens, Duncan, OK (US)

(73) Assignee: Flotek Industries, Inc.

( * ) Notice: Subject to any disclaimer, the term of this patent is extended or adjusted under 35 U.S.C. 154(b) by 0 days.

(21) Appl. No.: 10/370,672

(22) Filed: Feb. 21, 2003

(65) Prior Publication Data

US 2003/0161212 A1 Aug. 28, 2003

Related U.S. Application Data

(60) Provisional application No. 60/358,780, filed on Feb. 22, 2002.

(51) Int. Cl.[7] ..... B28C 5/06; B28C 7/04; B28C 7/16

(52) U.S. Cl. ..... 366/10; 366/27; 366/33; 366/51

(58) Field of Search ..... 366/10, 2, 3, 6, 366/8, 16, 17, 20, 30, 33, 34, 35, 36, 37, 40, 42, 43, 51, 27

(56) References Cited

U.S. PATENT DOCUMENTS 4,003,431 A * 1/1977 Novotny et al. ..... 366/17
4,089,053 A * 5/1978 Umphrey et al. ..... 366/51
4,239,396 A * 12/1980 Arribau et al. ..... 366/40
4,915,505 A * 4/1990 Arribau et al. ..... 366/136
5,026,168 A 6/1991 Berryman et al.
5,103,908 A * 4/1992 Allen ..... 366/17
5,114,239 A 5/1992 Allen
5,289,877 A 3/1994 Naegele et al.
5,355,951 A 10/1994 Allen et al.
5,538,341 A 7/1996 Padgett et al.
5,571,281 A * 11/1996 Allen ..... 366/2
6,193,402 B1 * 2/2001 Grimland et al. ..... 366/33
6,286,986 B2 * 9/2001 Grimland et al. ..... 366/2

* cited by examiner

*Primary Examiner*—Tony G. Soohoo
(74) *Attorney, Agent, or Firm*—Crowe & Dunlevy, P.C.

(57) ABSTRACT

The present disclosure provides a blender apparatus that can be used to prepare a slurry from carrier fluids and solids. In a preferred embodiment, the blender includes a mixing tub system, a fluids intake system, a solids intake system and a slurry delivery system. The fluids intake system preferably includes a first intake pump and a second intake pump that independently or cooperatively draw fluids into the blender. The slurry delivery system preferably includes a first discharge pump and a second discharge pump that independently or cooperatively delivery slurry from the mixing tub system.

18 Claims, 5 Drawing Sheets

MOBILE BLENDING APPARATUS

RELATED APPLICATIONS

This application claims priority to U.S. Provisional Patent Application No. 60/358,780 filed Feb. 22, 2002, entitled Mobile Blending Apparatus, which is hereby incorporated by reference.

FIELD OF THE INVENTION

This invention relates generally to the field of petroleum production, and more particularly, but not by way of limitation, to an improved blender apparatus useable in well stimulation processes.

BACKGROUND

For many years, petroleum products have been recovered from subterranean reservoirs through the use of drilled wells and production equipment. Ideally, the natural reservoir pressure is sufficient to force the hydrocarbons out of the producing formation to storage equipment located on the surface. In practice, however, diminishing reservoir pressures, near-wellbore damage and the accumulation of various deposits limit the recovery of hydrocarbons from the well.

Well stimulation treatments are commonly used to enhance or restore the productivity of a well. Hydraulic fracturing is a particularly common well stimulation treatment that involves the high-pressure injection of specially engineered treatment fluids into the reservoir. The high-pressure treatment fluid causes a vertical fracture to extend away from the wellbore according to the natural stresses of the formation. Proppant, such as grains of sand of a particular size, is often mixed with the treatment fluid to keep the fracture open after the high-pressure subsides when treatment is complete. The increased permeability resulting from the hydraulic fracturing operation enhances the flow of petroleum products into the wellbore.

Hydraulic fracturing operations require the use of specialized equipment configured to meet the particular requirements of each fracturing job. Generally, a blender unit is used to combine a carrier fluid with proppant material to form a fracturing slurry. The blender unit pressurizes and delivers the slurry to a pumper unit that forces the slurry under elevated pressure into the wellbore. During the fracturing operation, it is important that the slurry be provided to the pumper units at a sufficient pressure and volumetric flowrate. Failure to generate sufficient pressure at the suction side of each pumper unit can cause cavitation that damages the pumper units and jeopardizes the fracturing operation.

Prior art blender units are subject to failure resulting from the inherent difficulties of preparing and pressurizing solid-liquid slurries. Blenders typically include pumps, mixing tubs and motors that are vulnerable to mechanical failure under the rigorous demands of high-volume blending operations. Accordingly, there is a continued need for a more robust blender apparatus that meets the needs of modem hydraulic fracturing operations.

SUMMARY OF THE INVENTION

The present invention includes a blender apparatus that can be used to prepare a slurry from carrier fluids and solids. In a preferred embodiment, the blender includes a mixing tub system, a fluids intake system, a solids intake system and a slurry delivery system. The fluids intake system preferably includes a first intake pump and a second intake pump that independently or cooperatively draw fluids into the blender. The slurry delivery system preferably includes a first discharge pump and a second discharge pump that independently or cooperatively deliver slurry from the mixing tub system.

DETAILED DESCRIPTION OF THE PREFERRED EMBODIMENT

Figure 1:
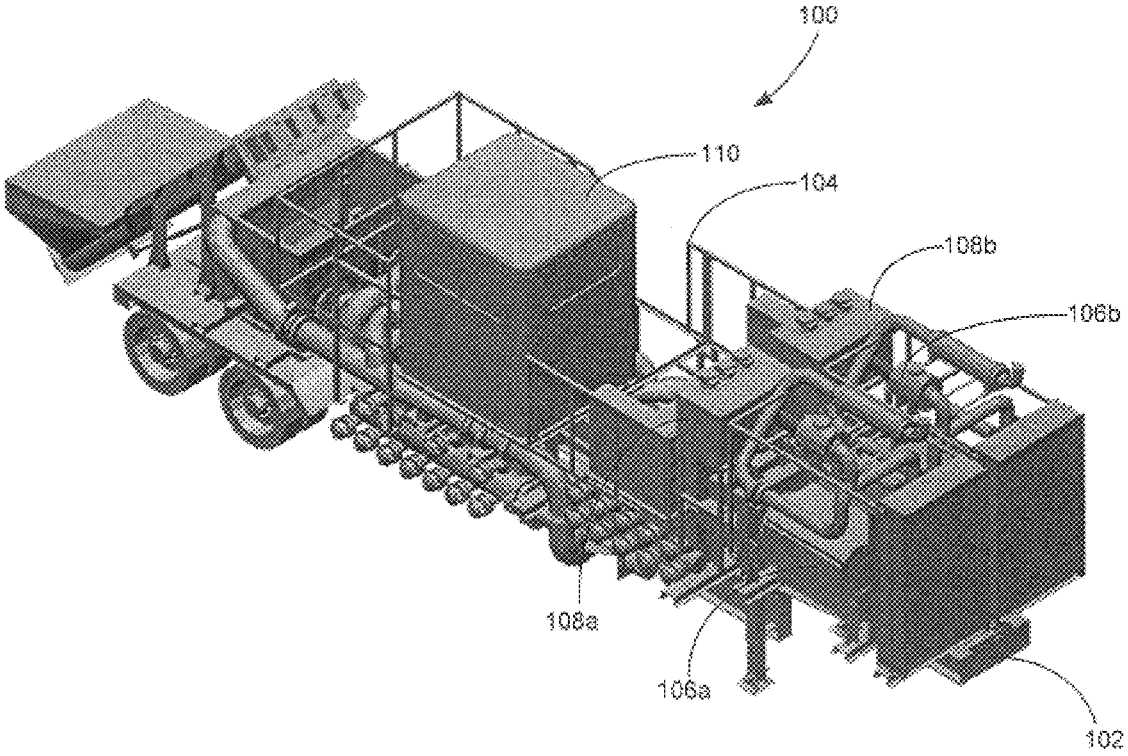
FIG. 1 is an aerial perspective view a mobile blender apparatus constructed in accordance with a preferred embodiment of the present invention.

Referring to FIG. 1, shown therein is an aerial, front passenger-side view of a blender apparatus 100 constructed in accordance with a preferred embodiment of the present invention. On a fundamental level, the blender 100 is configured to combine a carrier fluid with solids to create a slurry mixture that is useable in hydraulic fracturing operations. It will be understood, however, that alternative uses for the blender 100 are available and encompassed within the scope of the present invention.

As shown in FIG. 1, the blender 100 is mounted on a chassis 102 that is configured for connection with a semi-tractor (not shown). The ability to move the blender 100 with a semi-tractor facilitates the deployment of the blender 100 in remote locations. It will be noted, however, that the blender 100 can also be supported on skids or mounted on marine vessels for offshore use. A platform 104 is supported by the chassis 102 and permits human access to the various components of the blender 100.

The blender 100 is generally powered by a pair of engines 106. In the presently preferred embodiment, two 850 horsepower diesel engines 106*a*, 106*b* are mounted on the front portion of the chassis 102 and connected to separate hydraulic generators 108*a*, 108*b* that produce pressurized hydraulic fluid that can be used by the various systems on the blender 100. It is preferred that the engines 106 be sized and configured such that one engine 106 and one generator 108 are capable of producing sufficient hydraulic pressure and flowrate to supply each of the systems on the blender 100 while operating at a maximum desired capacity. As such, the blender 100 can continue to operate despite the failure of a single engine 106. The "maximum desired capacity" is a variable term that depends on a number of factors, including upstream supply, downstream demand, operational safety, operational efficiency and the size of the blender 100 and associated components.

Continuing with FIG. 1, the blender 100 also includes an enclosed operator booth, or "doghouse" 110 that is outfitted with controls and monitoring equipment. Alternatively, the blender 100 can be monitored and operated via a remote control system. The controls and monitoring equipment can be used to observe and adjust a number of parameters, including engine and hydraulic conditions, pump rates and pressures, sand screw rates, liquid additive system rates, and slurry density. The controls and monitoring equipment can include internal logging hardware or data connections to external logging equipment.

Figure 2:
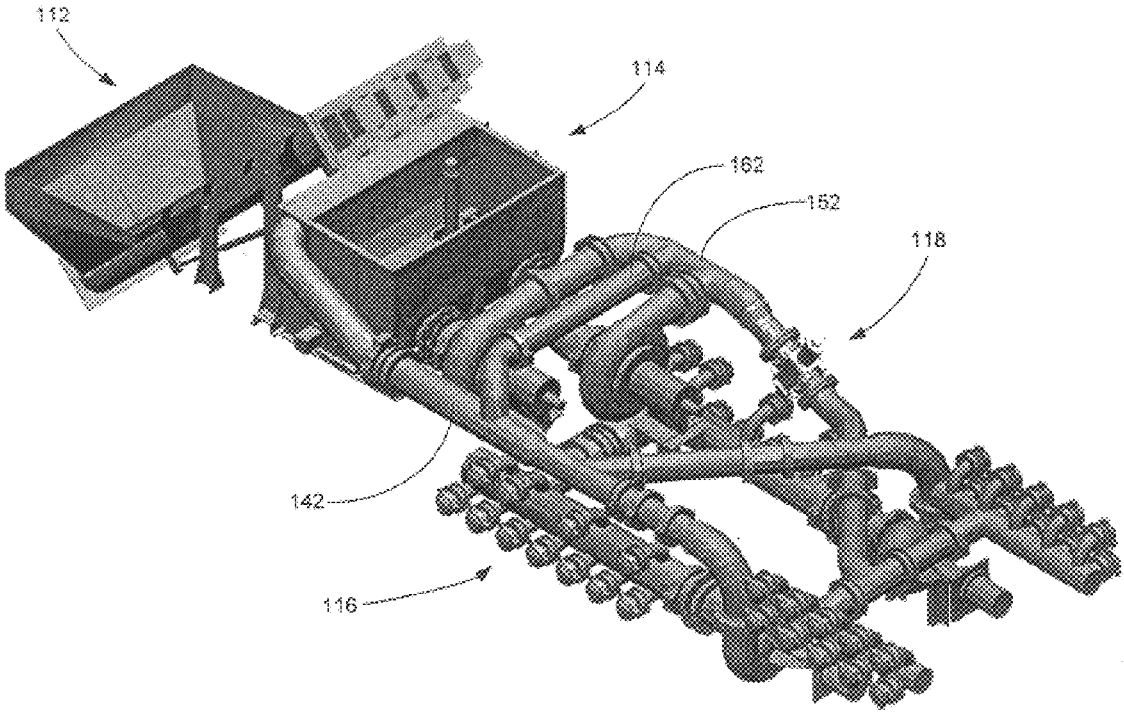
FIG. 2 is a perspective view of the material handling systems of the blender apparatus of FIG. 1.

Turning to FIG. 2, shown therein are the materials handling systems of the blender 100. The materials handling systems generally include a solids intake system 112, a mixing tub system 114, a fluids intake system 116 and a slurry delivery system 118. Although the presently preferred configuration of the materials handling systems is shown in FIG. 2, it will be understood that the rearrangement of these components and systems is within the scope of the present invention. For example, in an alternate embodiment, the positions of the solids intake system 112 and engines 106 could be interchanged on the back and the front of the chassis 102, respectively.

Figure 3:
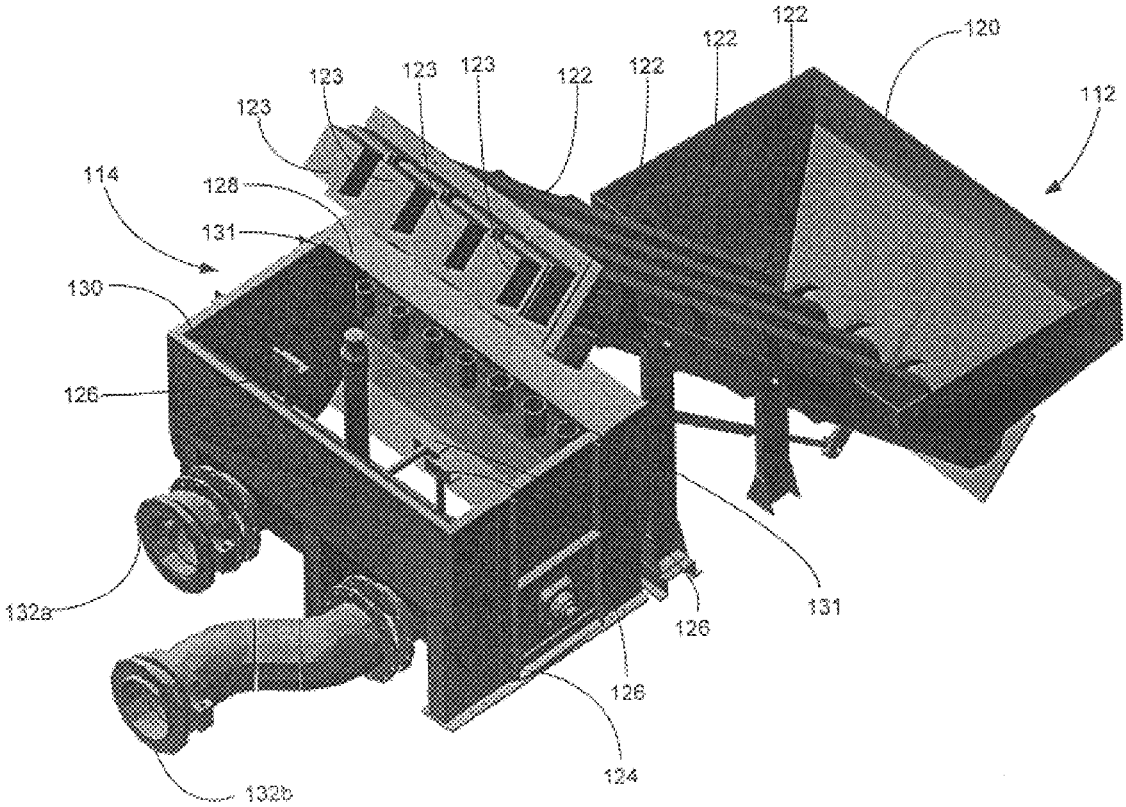
FIG. 3 is a perspective view of the solids intake system and mixing tub system of the blender apparatus of FIG. 1.

FIG. 3 provides an isolated perspective view of the driver's side of the solids intake system 112 and the mixing tub system 114. The solids intake system 112 includes a hopper 120 and a plurality of sand screws 122. Preferably, the solids intake system 112 includes four sand screws 122 that use conventional augers that are driven by independent, hydraulically powered sand screw motors 123. In a particularly preferred embodiment, each of the sand screws 122 are powered by independent Rineer hydraulic motors available from the Rineer Hydraulics, Inc. of San Antonio, Tex. Preferably, not all of the sand screw motors 123 are powered by a single hydraulic generator 108 and engine 106. The use of independent sand screw motors 123 for each sand screw 122 provides full redundancy that enables the continued operation of the solids intake system 112 in the event one or more of the sand screw motors 123 fails.

The sand screws 122 are positioned relative the hopper 120 such that, as solids or "proppant" is introduced into the hopper 120, the sand screws 122 lift the proppant to a position above the mixing tub system 114. The proppant is expelled into the mixing tub system 114 from the top end of the sand screws 122. To facilitate mixing, it is preferred that the proppant be delivered to the mixing tub system 114 in a substantially uniform flow profile.

The rate of proppant delivery to the mixing tub system 114 can be controlled by adjusting the angle and rotation of the sand screws 122 or through use of restriction valves in the hopper 120. The feed of proppant from the hopper 120 to the mixing tub system 114 is preferably automated with controls in response to preset thresholds, upstream supply or downstream demand.

The mixing tub system 114 preferably includes a rounded tank 124 that is configured to permit the rotation of at least one paddle 126. In the presently preferred embodiment, the mixing tub system 114 includes four paddles 126 that rotate about an axis transverse to the length of the blender 100. The paddles 126 are preferably fixed to a common axle (not separately designated) that is hydraulically driven. The paddles 126 are designed to enhance the slurry mixing process caused by the combination of proppant and liquid in the mixing tub system 114. It will be noted, however, that the paddles 126 are not required for the successful preparation of the slurry.

The mixing tub system 114 also includes a fluids distribution manifold 128 and a slurry deflector 130. The fluids distribution manifold 128 evenly distributes the incoming carrier fluid across the width of the tank 124. The fluids distribution manifold 128 (shown with the front side removed in FIG. 3) includes a plurality of injection ports 131 that evenly distribute the incoming carrier fluid within the mixing tub system 114. The diameter of the individual injection ports 131 preferably varies to accommodate for pressure losses across the fluids distribution manifold 128. The even distribution of carrier fluid within the mixing tub system 114 provides enhances the wetting and mixing of the proppant material as it falls from the sand screws 122. The slurry deflector 130 (best visible in FIG. 4), reduces splashing, spillage and encourages the proper "roll-over" of the slurry mixture as it turns in the tank 124.

The mixing tub system 114 preferably includes a dry add proportioner (not shown) and slurry level detectors that provide automated control of the composition and level of the slurry in the mixing tub system 114, respectively. The mixed slurry exits the mixing tub system 114 through a pair of mixing tub discharge pipes 132*a*, 132*b* to the slurry delivery system 118. The limited number of moving parts and relatively simple design of the mixing tub system 114 significantly improves the overall robustness of the blender 100.

In an alternative embodiment, the blender 100 includes a plurality of mixing tub systems 114, each with separate tanks 124, fluids distribution manifolds 128, slurry deflectors 130, paddles 126 and mixing tub discharge pipes 132. Preferably, each of the plurality of mixing tub systems 114 are sized and configured to individually enable the maximum desired operating capacity of the blender 100. As such, the blender 100 is capable of operating at a maximum desired capacity while using a single mixing tub system 114.

Figure 4:
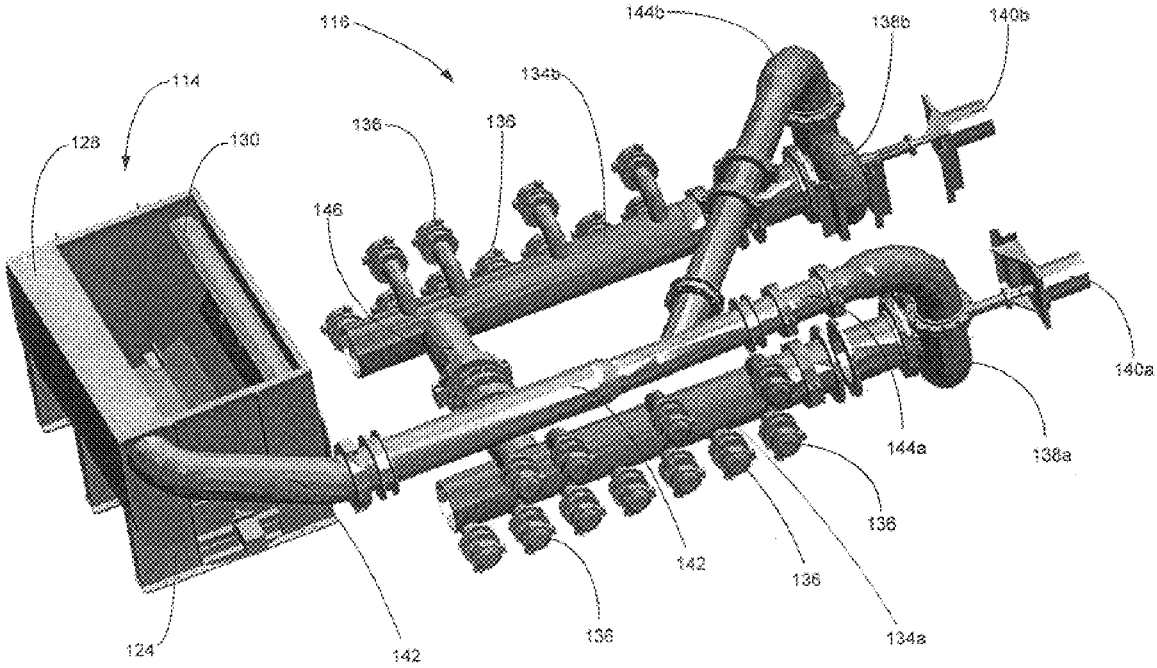
FIG. 4 is a perspective view of the mixing tub system and fluids intake system of the blender apparatus of FIG. 1.

Turning to FIG. 4, shown therein is an aerial view of the passenger-side of the fluids intake system 116. The fluids intake system 116 includes a pair of suction headers 134*a*, 134*b* that are configured for connection to an upstream source of carrier fluid, such as bulk liquid storage tanks or gel hydration units. Both of the suction headers 134*a*, 134*b* include a plurality of suction connectors 136 for facilitated attachment to upstream hoses or piping. Although any suitable connector 136 could be used, hammer unions are presently preferred.

The fluids intake system 116 also includes a pair of intake pumps 138*a*, 138*b* that are located in fluid communication with the suction headers 134*a*, 134*b*, respectively. Although a number of pumps could be successfully employed, intake pumps 138*a*, 138*b* are preferably hydraulically driven centrifugal pumps that are capable of pumping a variety of carrier fluids. The intake pumps 138*a*, 138*b* are preferably sized and configured such that the blender 100 is capable of operating at a maximum desired capacity with only a single intake pump 138.

In a particularly preferred embodiment, the intake pumps 138*a*, 138*b* are 10"×8" centrifugal pumps connected to 180 horsepower intake pump motors 140*a*, 140*b*. Suitable models are available from the Blackmer Company of Grand Rapids, Mich. under the MAGNUM trademark. Although the intake pump motors 140*a*, 140*b* preferably utilize hydraulic pressure generated by the engines 106, it will be understood that independent engines could be used to power the intake pumps 138*a*, 138*b*.

The fluids intake system 116 further includes an intake manifold 142 and a pair of intake pump discharge lines 144*a*, 144*b*. The intake pump discharge lines 144*a*, 144*b* delivery pressurized carrier fluid from the intake pumps 138*a*, 138*b* to the intake manifold 142. The intake manifold 142 delivers the pressurized carrier fluid from the intake pump discharge lines 144*a*, 144*b* to the fluids distribution manifold 128 of the mixing tub system 114.

The fluids intake system 116 additionally includes a suction header crossover 146. The crossover 146 enables the use of a single intake pump 138 to draw carrier fluids from either or both of the suction headers 134*a*, 134*b*. In this way, the fluids intake system 116 can be operated at full load with a single intake suction pump 138. The flow of carrier fluids through the intake fluids system 116 is preferably controlled with conventional control valves (not shown).

Figure 5:
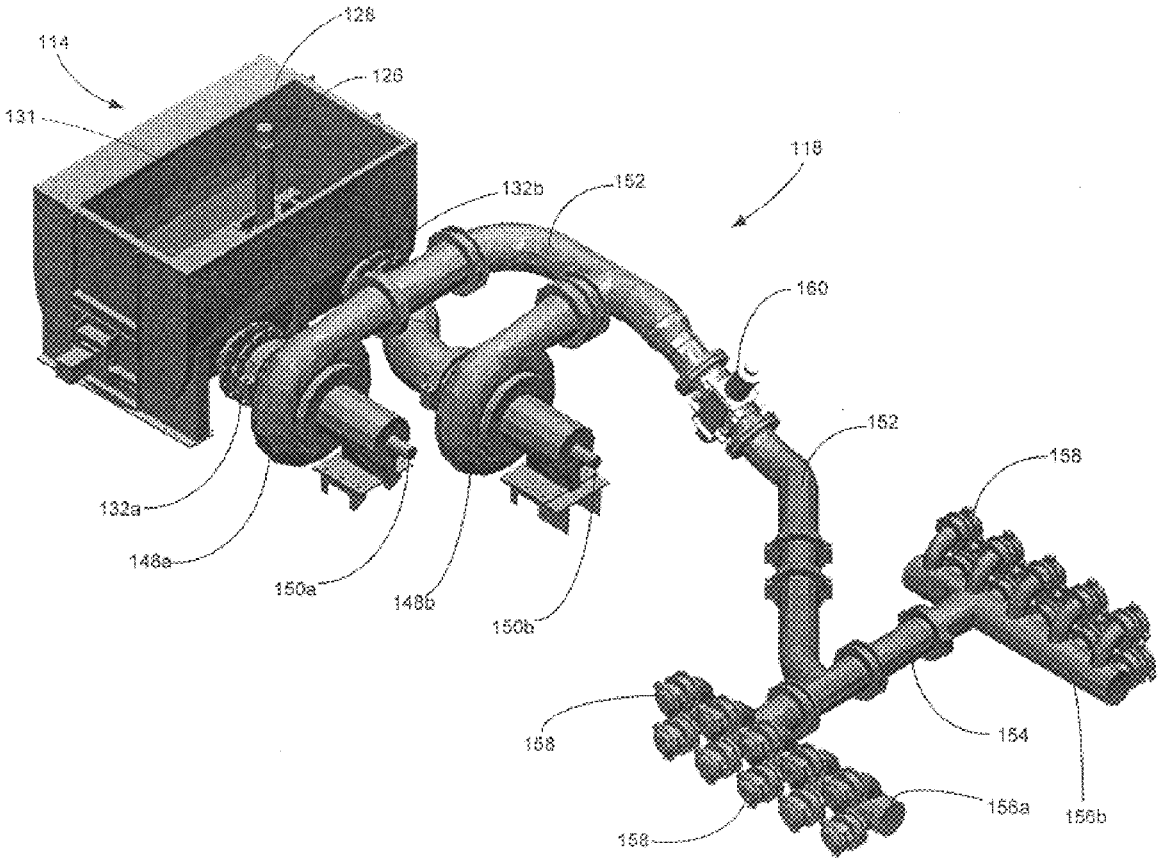
FIG. 5 is a perspective view of the mixing tub system and slurry delivery system of the blender apparatus of FIG. 1.

Turning next to FIG. 5, shown therein is an aerial view of the passenger-side of the slurry delivery system 118. Generally, the slurry delivery system 118 transfers the slurry under pressure from the mixing tub system 114 to downstream equipment, such as pumper units or storage facilities.

The slurry delivery system 118 includes a pair of discharge pumps 148*a*, 148*b* and a pair of discharge pump motors 150*a*, 150*b*. In the presently preferred embodiment, the discharge pumps 148*a*, 148*b* are 12"×10" centrifugal pumps that are functionally coupled to the discharge pump motors 150*a*, 150*b*, respectively. Suitable pumps are available from the Blackmer Company under the MAGNUM XP trademark. Although the discharge pump motors 150*a*, 150*b* are preferably 250 horsepower motors that utilize hydraulic pressure generated by the engines 106, it will be understood that independent engines could be used to power the discharge pumps 148*a*, 148*b*.

The discharge pumps 148*a*, 148*b* are separately connected to the mixing tub discharge pipes 132*a*, 132*b*. The discharge pumps 148*a*, 148*b* are preferably sized and configured, however, such that the blender 100 is capable of operating at a maximum desired capacity with only a single discharge pump 148. Accordingly, in the event that one of the discharge pumps 148 fails, the output of the other discharge pump 148 can be increased to compensate for the failed pump 148.

The slurry delivery system 118 also includes an upper discharge manifold 152, a lower discharge manifold 154 and a pair of discharge headers 156*a*, 156*b*. The upper discharge manifold 152 transfers the collective high pressure output from the discharge pumps 148*a*, 148*b* to the discharge headers 156*a*, 156*b* through the lower discharge manifold 154. Control valves (not shown) in the lower discharge manifold 154 can be used to divert the flow of slurry to one or both of the discharge headers 156*a*, 156*b*. The discharge headers 156*a*, 156*b* preferably include connectors 158 that can be used for facilitated connection to downstream equipment. Although any suitable connector 158 could be used, hammer unions are presently preferred.

The slurry delivery system 118 also includes a densometer 160 for measuring the consistency of the slurry output by the mixing tub system 114. In the presently preferred embodiment, the densometer 160 is installed in the upper discharge manifold 152. The signal output by the densometer 160 can be used to automatically adjust a number of variables, such as sand intake, liquid intake and agitation rates, to control the density of the slurry. Although a variety of models are acceptable, nuclear densometers 160 are presently preferred.

Referring back to FIG. 2, the slurry delivery system 118 also includes a bypass line 162 (not shown in FIG. 5). The bypass line 162 connects the upper discharge manifold 152 to the intake manifold 142. With conventional control valves, the bypass line 162 can be used to divert some of the intake fluids around the mixing tub system 114 to adjust the consistency of the slurry delivered from the blender 100. It will be appreciated that the bypass line 162 can also be used to bypass the mixing tub system 114 entirely. The complete bypass of the mixing tub system 114 is useful for transferring carrier fluids without the need for slurry preparation during "flush" operations.

The bypass line 162 can also be used to recycle slurry around the mixing tub system 114. Using control valves in the upper discharge manifold 152, some of the slurry output from the mixing tub system 114 can be directed into the intake manifold 142 for reintroduction into the mixing tub system 114. The partial recycle of slurry around the mixing tub system 114 can be used to adjust the consistency of the slurry discharged from the blender 100. Alternatively, the full recycle of slurry around the mixing tub system 114 can be used to maintain the suspension of proppant material in the carrier fluid when the blender 100 is not delivering slurry to downstream equipment.

In the preferred embodiments disclosed above, the blender 100 includes redundant components that enable the continued operation of the blender 100 at a maximum desired capacity in the event that one or more components fail. For example, one of each of the two engines 106*a*, 106*b*, two intake pumps 134*a*, 134*b* and two discharge pumps 148*a*, 148*b*, are capable of permitting the operation of the blender 100 at a maximum desired capacity. Furthermore, the redundant and modular design of the blender 100 permits the on-site replacement and repair of damaged components without interrupting the blending operation.

It is clear that the present invention is well adapted to carry out its objectives and attain the ends and advantages mentioned above as well as those inherent therein. While presently preferred embodiments of the invention have been described in varying detail for purposes of disclosure, it will be understood that numerous changes may be made which will readily suggest themselves to those skilled in the art and which are encompassed within the spirit of the invention disclosed herein, in the associated drawings and appended claims.

What is claimed is:

1. A blender apparatus useable for preparing a slurry from carrier fluids and solids, the blender comprising:

a mixing tub system;

a fluids intake system, wherein the fluids intake system includes a first intake pump and a second intake pump that independently or cooperatively draw fluids into the blender;

a solids intake system configured to introduce solids into the mixing tub system; and a slurry delivery system, wherein the slurry delivery system includes a first discharge pump and a second discharge pump that independently or cooperatively delivery slurry from the mixing tub system.

2. The blender apparatus of claim 1, wherein the mixing tub system includes a fluids distribution manifold and a slurry deflector.

3. The blender apparatus of claim 2, wherein the fluids distribution manifold includes a plurality of injection ports configured to evenly distribute fluids within the mixing tub system.

4. The blender apparatus of claim 1, wherein the mixing tub system further includes:

a tank; and a first mixing tub discharge pipe connected to the tank; and a second mixing tub discharge pipe connected to the tank.

5. The blender apparatus of claim 1, wherein the fluids intake system further includes:

a first suction header connected to the inlet first intake pump and a second suction header connected to the inlet second intake pump;

a first intake pump discharge line connected to the outlet of the first intake pump and a s econd intake pump discharge line connected to the outlet of the second intake pump; and an intake manifold, wherein the intake manifold connects the first and second intake pump discharge lines to the mixing tub system.

6. The blender apparatus of claim 5, wherein the fluids intake system further includes:

a suction headers crossover that connects the first and second suction headers such that the first or second intake pump can be independently used to pull carrier fluids from the first and second suction headers.

7. The blender apparatus of claim 1, wherein the slurry delivery system further comprises:

an upper discharge manifold connected to the first and second discharge pumps;

a lower discharge manifold connected to the upper discharge manifold;

a first discharge header connected to the lower discharge manifold; and a second discharge header connected to the lower discharge manifold.

8. The blender apparatus of claim 1, wherein the slurry delivery system further comprises a bypass line that connects the slurry delivery system to the fluids intake system.

9. The blender apparatus of claim 8, wherein the bypass line permits the movement of carrier fluids through the blender apparatus without use of the mixing tub system.

10. The blender apparatus of claim 1, wherein the slurry delivery system further comprises a densometer that outputs a signal representative of the consistency of the slurry delivered by the blender apparatus.

11. A mobile blender apparatus useable for preparing a slurry from carrier fluids and solids, the blender apparatus comprising:

a first engine;

a first hydraulic generator connected to the first engine, wherein first the hydraulic generator produces a first source of pressurized hydraulic fluid;

a first intake pump powered by the first source of pressurized hydraulic fluid;

a first discharge pump powered by the first source of pressurized hydraulic fluid;

a second engine;

a second hydraulic generator connected to the second engine, wherein second the hydraulic generator produces a second source of pressurized hydraulic fluid;

a second intake pump powered by the second source of pressurized hydraulic fluid; and a second discharge pump powered by the second source of pressurized hydraulic fluid.

12. The blender apparatus of claim 11, wherein the first intake pump and first discharge pump can be powered by the second source of pressurized hydraulic fluid.

13. The blender apparatus of claim 12, further comprising:

a mixing tub system, wherein the mixing tub system includes:

a tank;

a first discharge pipe connected to the first discharge pump; and a second discharge pipe connected to the second discharge pump.

14. The blender apparatus of claim 11, wherein the first intake pump and second intake pump are each independently sized and configured to draw a maximum capacity of carrier fluids into the blender apparatus.

15. The blender apparatus of claim 11, wherein the first discharge pump and second discharge pump are each independently sized and configured to expel a maximum capacity of slurry from the blender apparatus.

16. The blender apparatus of claim 15, wherein the blender apparatus has a length and the mixing tub system further comprises:

a paddle that rotates about an axis transverse to the length of the blender apparatus.

17. The blender apparatus of claim 16, further comprising:

a plurality of mixing tub systems.

18. A mobile blender apparatus comprising:

a mixing tub system;

a solids intake system configured to introduce solids into the mixing tub system;

intake means for drawing carrier fluids into the mixing tub system; and delivery means for discharging slurry from the blender apparatus.

* * * * *

UNITED STATES PATENT AND TRADEMARK OFFICE

CERTIFICATE OF CORRECTION

PATENT NO. : 6,644,844 B2
DATED : November 11, 2003
INVENTOR(S) : Dan Neal; John Callihan; Kavin Bowens It is certified that error appears in the above-identified patent and that said Letters Patent is hereby corrected as shown below:

Column 4,
Line 3, replace “provides enhances”, with -- enhances --.

Column 7,
Line 2, replace “s econd”, with -- second --.

Signed and Sealed this

First Day of June, 2004

JON W. DUDAS
*Acting Director of the United States Patent and Trademark Office*